US005745015A

United States Patent [19]

Tokudera et al.

[11] Patent Number: 5,745,015

[45] Date of Patent: Apr. 28, 1998

[54] NON-RECIPROCAL CIRCUIT ELEMENT HAVING A MAGNETIC MEMBER INTEGRAL WITH THE FERRITE MEMBER

[75] Inventors: Hiromu Tokudera; Katsuyuki Ohira, both of Nagaokakyo, Japan

[73] Assignee: Murata Manufacturing Co. Ltd., Japan

[21] Appl. No.: 756,727

[22] Filed: Nov. 26, 1996

[30] Foreign Application Priority Data

Nov. 27, 1995 [JP] Japan ..... 7-307120
Nov. 25, 1996 [JP] Japan ..... 8-313806

[51] Int. Cl.[6] ..... H01P 1/383

[52] U.S. Cl. ..... 333/1.1; 333/24.2

[58] Field of Search ..... 333/1.1, 24.2

[56] References Cited

U.S. PATENT DOCUMENTS 4,789,844 12/1988 Schloemann ..... 333/1.1
5,379,004 1/1995 Marusawa et al. ..... 333/1.1

FOREIGN PATENT DOCUMENTS 0664573 7/1995 European Pat. Off. .
0707353 4/1996 European Pat. Off. .
1282754 11/1968 Germany .
62-183406 11/1987 Japan .
9530252 11/1995 WIPO .

*Primary Examiner*—Paul Gensler
*Attorney, Agent, or Firm*—Ostrolenk, Faber, Gerb & Soffen, LLP

[57] ABSTRACT

A non-reciprocal circuit element of reduced weight and manufactured at a lower cost without deteriorating the parallelism and the magnetic field distribution of a unidirectional magnetic field. The non-reciprocal circuit element may be a circulator having a ferrite member having a center electrode section in which a plurality of electrode lines which function as inductance components are disposed so as to intersect each other, forming a predetermined angle therebetween while being electrically insulated from each other. In this circulator, a magnetic member made of a magnetic material having a permeability higher than that of the ferrite member is formed integrally with a lower surface of the ferrite member. The ferrite member also has matching capacitance electrodes connected to input/output ports of the electrode lines to function as capacitance components. The center electrode section and the matching capacitance electrodes are incorporated in the ferrite member. A permanent magnet is also provided to apply a unidirectional magnetic field to an intersection portion of the center electrode section of the ferrite member.

15 Claims, 11 Drawing Sheets

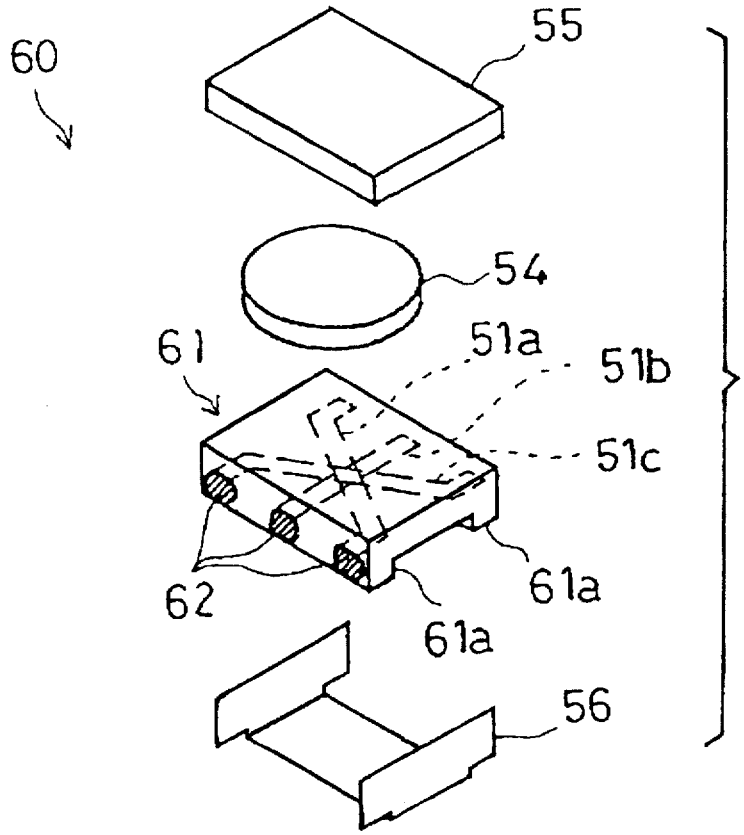
FIG. 13
FIG. 14
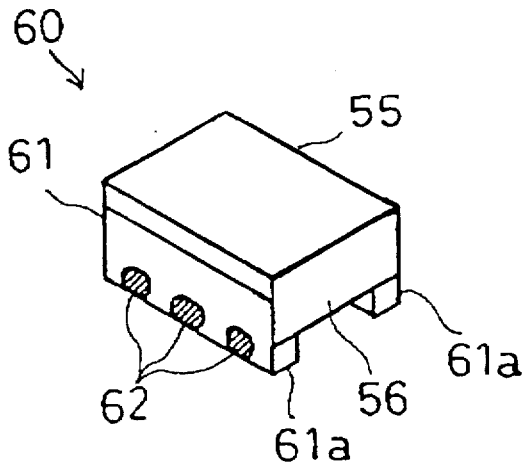

NON-RECIPROCAL CIRCUIT ELEMENT HAVING A MAGNETIC MEMBER INTEGRAL WITH THE FERRITE MEMBER

BACKGROUND OF THE INVENTION

1. Field of the Invention

The present invention relates to a microwave electronic part, in particular, to a non-reciprocal circuit element such as an isolator or a circulator.

2. Description of the Related Art

Concentrated constant type isolators and circulators for use in a microwave band have a function of allowing passage of a signal only in a desired transmission direction while stopping transmission in the opposite direction. For example, such devices are adapted for use in a mobile communication apparatus such as a portable telephone system.

FIGS. 15 and 16 illustrate one example of such a circulator. The circulator 50 shown in FIGS. 15 and 16 is constructed as described below. A resin block 53 in which terminals 57 are embedded is placed under a lower surface of a ferrite member 52. Three central electrodes 51*a*, 51*b*, 51*c* and matching capacitance electrodes (not shown) are incorporated in the ferrite member. A permanent magnet 54 is placed on an upper surface of the ferrite member 52. These components are accommodated between upper and lower metallic case members 55 and 56.

Another example of a circulator is shown in FIGS. 13 and 14. In the circulator 60, a ferrite member 61 has a pair of projections 61*a*. Terminal electrodes 62, to which central electrodes 51*a* to 51*c* are connected, are formed on the bottom surface of projections 61*a*. According to such structure, the resin block 53 and the metallic terminals 57 of the previous example are not needed, thereby achieving a low-cost design and increasing the reliability of the operation of the circulator.

FIG. 12 shows an equivalent circuit diagram of both of the above-described circulators 50 and 60. Matching capacitances C1 to C3 are connected to input/output ports P1 to P3 of the center electrodes 51*a* to 51*c* which function as inductance components, and a direct-current magnetic field H is applied to the ferrite member 52 or 61.

In order to improve the parallelism of the magnetic field applied to the ferrite member 52 or 61, so as to make the magnetic field distribution in the ferrite member more uniform and to reduce leakage of the magnetic field, a closed magnetic field is conventionally formed by disposing the lower case member 56 under the lower surface of the ferrite member 52 or 61 and by connecting the upper case member 55 to the lower case member 56. Advantageously the case members 55 and 56 are made of a metal such as iron.

There is a demand for non-reciprocal circuit elements smaller in size and weight and lower in manufacturing cost, particularly for use in mobile communication apparatus of the above-mentioned kinds. The above-described non-reciprocal circuit elements, however, require the structure using upper and lower case members to form a closed magnetic path. To keep the lower case insulated from the metal terminals 57 while securing the lower case under the resin block 53, it is necessary to provide the lower portion of the resin block 53 with a concave shape. This results in an increase of manufacturing cost.

Also, the increase in manufacturing cost corresponding to the increase in the number of component parts is a consideration.

Further, in accordance with the conventional non-reciprocal circuit element, an air layer between the resin block 53 and the lower case member 56 causes an anti-magnetic field which decreases the homogeneity of the distribution of the magnetic field.

Also, leakage of the magnetic field from the air layer may be expected. Leakage of the magnetic field affects the operation of peripheral circuit elements.

SUMMARY OF THE INVENTION

An object of the present invention is to provide a non-reciprocal circuit element which can be reduced in size and manufacturing cost with high parallelism, high homogeneity and low leakage of the magnetic field.

To achieve the above-described and other objects, according to one aspect of the present invention, there is provided a non-reciprocal circuit element comprising a ferrite member having a center electrode section in which a plurality of electrode lines which function as inductance components are disposed so as to intersect each other, forming a predetermined angle between respective pairs of said electrode lines and being electrically insulated from each other. A magnetic member is formed integrally with at least one of the lower and upper surfaces of the ferrite member, the magnetic member being made of a magnetic material having a permeability higher than that of the ferrite member and the magnetic member preferably being insulative or non-electrically conducting.

The ferrite member also has matching capacitance electrodes connected to input/output ports of the electrode lines to function as capacitance components. The center electrode section and the matching capacitance electrodes are formed on one major surface of the ferrite member or inside the ferrite member. A permanent magnet applies a direct-current magnetic field to an intersection portion of the center electrode section of the ferrite member.

In the above-described non-reciprocal circuit element, according to a second aspect of the present invention, terminal electrodes to which the input/output ports of the electrode lines are connected are formed on at least one surface of the magnetic member.

In the above-described non-reciprocal circuit element, according to a third aspect of the present invention, the ferrite member, the permanent magnet and the magnetic member are placed inside a magnetic yoke assembly formed of a magnetic material having a permeability higher than that of the ferrite member.

Other features and advantages of the present invention will become apparent from the following description of the invention which refers to the accompanying drawings.

BRIEF DESCRIPTION OF THE DRAWINGS

FIG. 13 is an exploded perspective view of a conventional circulator for explaining the background of the present invention;

FIG. 14 is a perspective view of the circulator shown in FIG. 13;

DESCRIPTION OF EMBODIMENTS OF THE INVENTION

Embodiments of the present invention will be described below with reference to the accompanying drawings.

Figure 1:
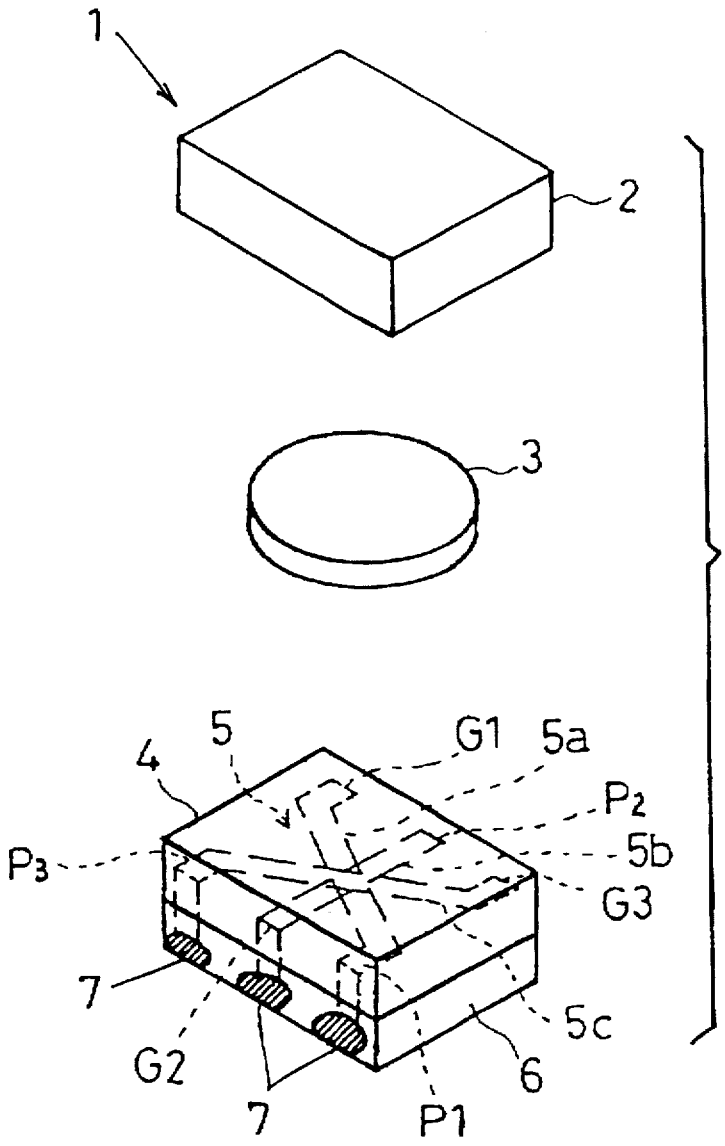
FIG. 1 is an exploded perspective view of a circulator which represents an embodiment of the present invention.
Figure 2:
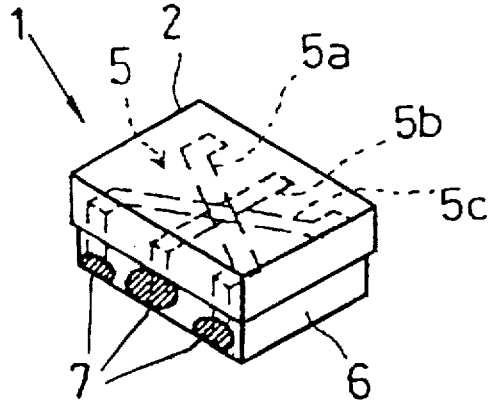
FIG. 2 is a perspective view of the circulator shown in FIG. 1.
Figure 3:
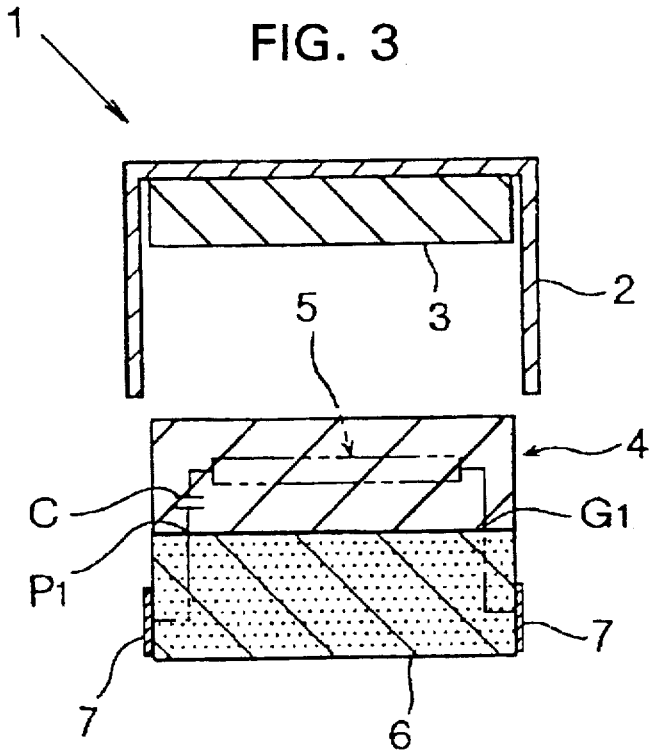
FIG. 3 is a cross-sectional partly assembled view of the circulator shown in FIG. 1.

Referring to FIGS. 1 through 3, a concentrated constant type circulator 1 which represents an embodiment of the present invention has a box-like iron case 2, a disk-like permanent magnet 3 placed under an inner surface of the iron case 2, and a ferrite member 4 in the form of a rectangular prism placed under a lower surface of the permanent magnet 3. A unidirectional magnetic field is applied by the permanent magnet 3 to the ferrite member 4. The ferrite member 4 may be, e.g. yttrium-iron-garnet ("YIG") or calcium-vanadium-garnet ("CaVaG").

The ferrite member 4 has an internal center electrode section 5. The center electrode section 5 has a structure such that three electrode lines 5*a* to 5*c* which function as inductance components are disposed so as to intersect each other by forming an angle of 120° between each pair of them while being maintained in an electrically insulated state. Matching capacitance electrodes C connected to input/output ports P1 to P3 of the electrode lines 5*a* to 5*c* are also incorporated in the ferrite member 4. The input/output ports P1 to P3 and grounding conductors G1 to G3 of the electrode lines 5*a* to 5*c* extend to be exposed at a lower surface of the ferrite member 4.

The above-described center electrode section 5 is of a cavity construction such that a cavity is formed in the ferrite member 4, and the electrode lines 5*a* to 5*c* and the capacitance electrodes C are formed in the cavity. It is possible to use, as an alternative to the above-described ferrite member structure, a structure in which electrode lines 5*a* to 5*c* are formed by patterning on the upper or lower surface of the above-described ferrite member, or a structure in which the above-described ferrite member 4 comprises a plurality of ferrite sheets, electrode lines 5*a* to 5*c* are formed on the ferrite sheets and the ferrite sheets are laid one on another to form the ferrite member into an integral body.

A magnetic member 6 in the form of a rectangular prism is connected to the lower surface of the ferrite member 4 so as to be integral with the ferrite member 4. In this case, "integral" means that these members are connected by laminating raw materials and firing the laminated product. According to such method, no air layer is provided between the laminated members. The magnetic member 6 and the upper case member 2 form a closed magnetic circuit. The magnetic member 6 preferably comprises an insulative, electrically non-conductive material. An example of the material of the magnetic member 6 is Ni-Zn ferrite or Mn-Zn ferrite. Other materials can also be used for magnetic member 6, as long as such materials have high permeability relative to the ferrite 4 and preferably, an insulative characteristic. The magnetic member 6 is formed of a magnetic material having a permeability higher than that of the ferrite member 4. More specifically, the magnetic member may be a material having a permeability of about several hundred. Since the magnetic member is insulative, terminal electrodes 7 are formed on opposite side surfaces of the magnetic member 6. The input ports P1 to P3 and the grounding conductors G1 to G3 are connected to the terminal electrodes 7.

The operation and advantages of this embodiment will next be described.

In the above-described circulator 1, the magnetic member 6 having a permeability higher than that of the ferrite member 4 is connected to the lower surface of the ferrite member 4 so as to be integral with the ferrite member 4. By using this magnetic member 6, the parallelism of the unidirectional magnetic field from the permanent magnet 3 can be improved and the magnetic field distribution in the ferrite member 4 can be made uniform. Further, a closed magnetic path preventing leakage of the magnetic field can be formed by the magnetic member 6 and the iron case member 2. As a result, the need for a lower case member such as that used in the conventional arrangement can be eliminated while the desired non-reciprocal characteristic is maintained. Correspondingly, the number of component parts is reduced to achieve a reduction in manufacturing cost as well as a reduction in weight.

Since terminal electrodes 7 are formed on the magnetic member 6, the need for the resin block in the conventional arrangement can be eliminated to also achieve a reduction in manufacturing cost. The thickness of the magnetic member 6 can be set to a desired value, e.g., a value substantially equal to the thickness of the lower case member in the conventional arrangement, thereby enabling a design with a reduced overall size.

The above-described magnetic member 6 can also function as a temperature compensator element for the circulator 1, thereby avoiding a deterioration in temperature characteristics.

This embodiment of the present invention has been described with respect to the case where the magnetic member 6 is formed under the lower surface of the ferrite member 4 so as to be integral with the ferrite member 4. However, the present invention is not limited to this arrangement. FIGS. 4 through 7 show other embodiments of the present invention. In these figures, components identical or corresponding to those shown in FIG. 3 are indicated by the same reference numerals.

Figure 4:
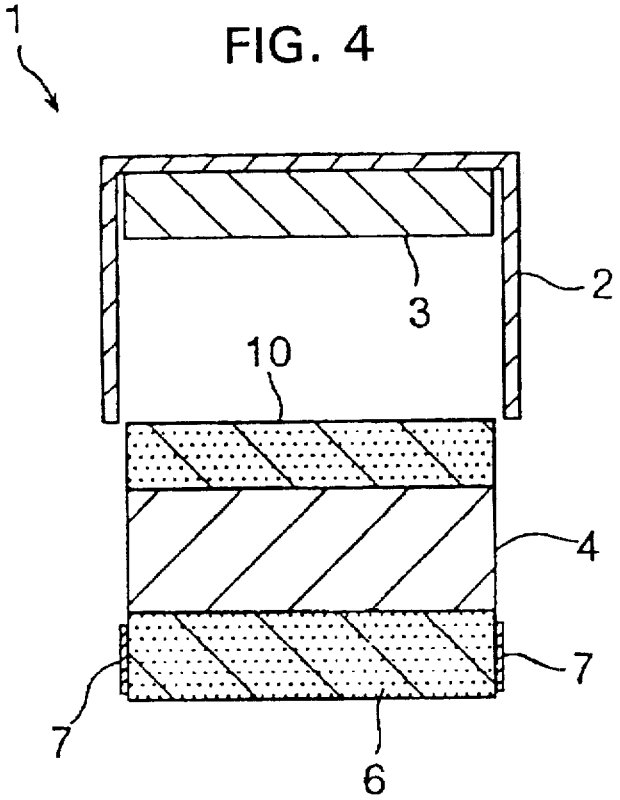
FIG. 4 is a diagram showing a circulator which represents another embodiment of the present invention.

FIG. 4 shows an embodiment in which a first magnetic member 6 is formed integrally with the lower surface of a ferrite member 4, and in which a second magnetic member 10 is formed integrally with the upper surface of the ferrite member 4. In this embodiment, the parallelism and the magnetic field distribution of the unidirectional magnetic field can be further improved because the magnetic members 6 and 10 are integrally formed on the two surfaces of the ferrite member 4.

Figure 5A:
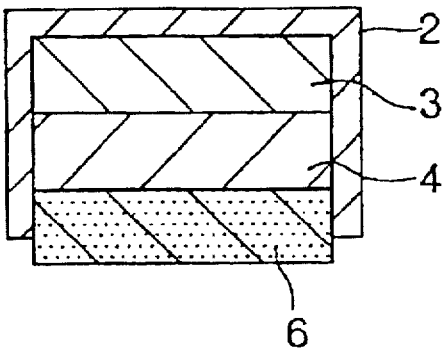
FIGS. 5A and 5B are diagrams showing circulators which represent other embodiments of the present invention.
Figure 5B:
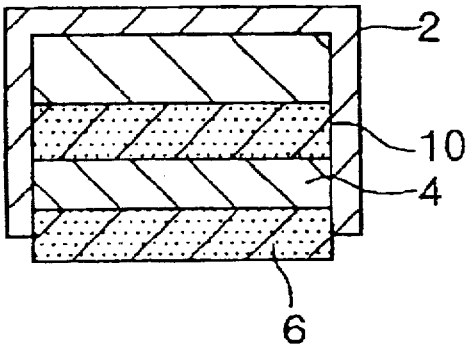

FIG. 5A shows an embodiment in which a magnetic member 6 is formed integrally with the lower surface of a ferrite member 4, and in which a permanent magnet 3 is integrally connected to the upper surface of the ferrite member 4. In FIG. 3, the members 3 and 4 are provided separately. The integral connection of FIG. 5A eliminates any chance for an air gap between members 3 and 4. FIG. 5B shows an embodiment in which magnetic members 6 and 10 are formed integrally with the lower and upper surfaces, respectively, of a ferrite member 4, and in which a permanent magnet 3 is integrally connected to the upper surface of the magnetic member 10. In these embodiments, because the permanent magnet 3 is integrally connected to the ferrite member 4, the number of component parts can be further reduced to achieve a reduction in manufacturing cost, and the facility with which the component parts are assembled can be improved.

Figure 6A:
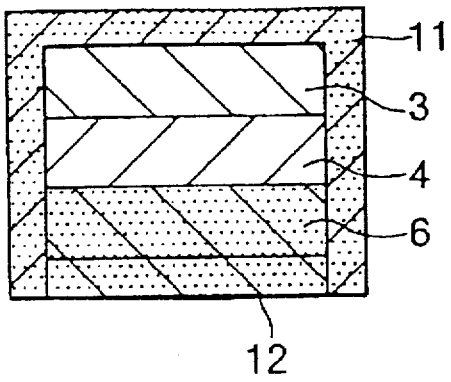
FIGS. 6A and 6B are diagrams showing circulators which represent further embodiments of the present invention.
Figure 6B:
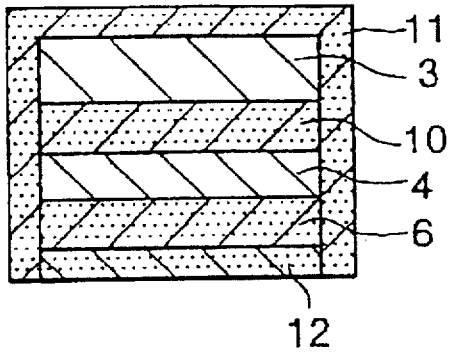

FIG. 6A shows an embodiment in which an upper yoke 11 and a lower yoke 12 are formed of a magnetic material having a permeability higher than that of ferrite, and in which a permanent magnet 3, a ferrite member 4 and a magnetic member 6 are accommodated in the space formed by the upper and lower yokes 11 and 12. FIG. 6B shows an embodiment in which a permanent magnet 3, a ferrite member 4 and magnetic members 6 and 10 are accommodated in the space formed by the same upper and lower yokes 11 and 12. In these embodiments, because a closed magnetic circuit is formed by the upper and lower yokes 11 and 12, the need for upper and lower iron case members can be eliminated to achieve further reductions in manufacturing cost. The magnetic material of the upper and lower yokes 11 and 12 may be the same material as magnetic member 6.

Figure 7A:
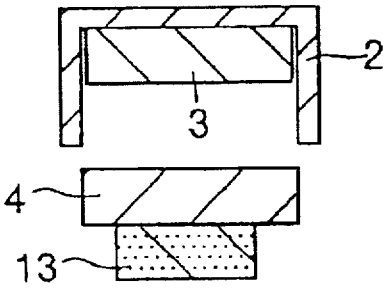
FIGS. 7A and 7B are diagrams showing circulators which represent still further embodiments of the present invention.
Figure 7B:
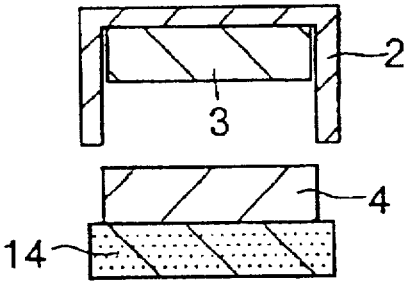

FIG. 7A shows an embodiment in which a magnetic member 13 smaller than a ferrite member 4 is formed integrally with the lower surface of the ferrite member 4. FIG. 7B shows an embodiment in which a magnetic member 14 larger than a ferrite member 4 is formed integrally with the lower surface of the ferrite member 4. The shapes of each of the above-described ferrite members, magnetic members and permanent magnets are not particularly limited, and these members may be formed into any shape such as a circular or polygonal shape.

The embodiments of the present invention have been described as a three port circulator by way of example. However, the present invention can also be applied to an isolator in which a terminating resistor is connected to one port. Also in such an application, the present invention can be as advantageous as described above.

FIGS. 8 through 11 show the results of an experiment made to confirm the advantages of the present invention with respect to the above-described embodiments.

Figure 8:
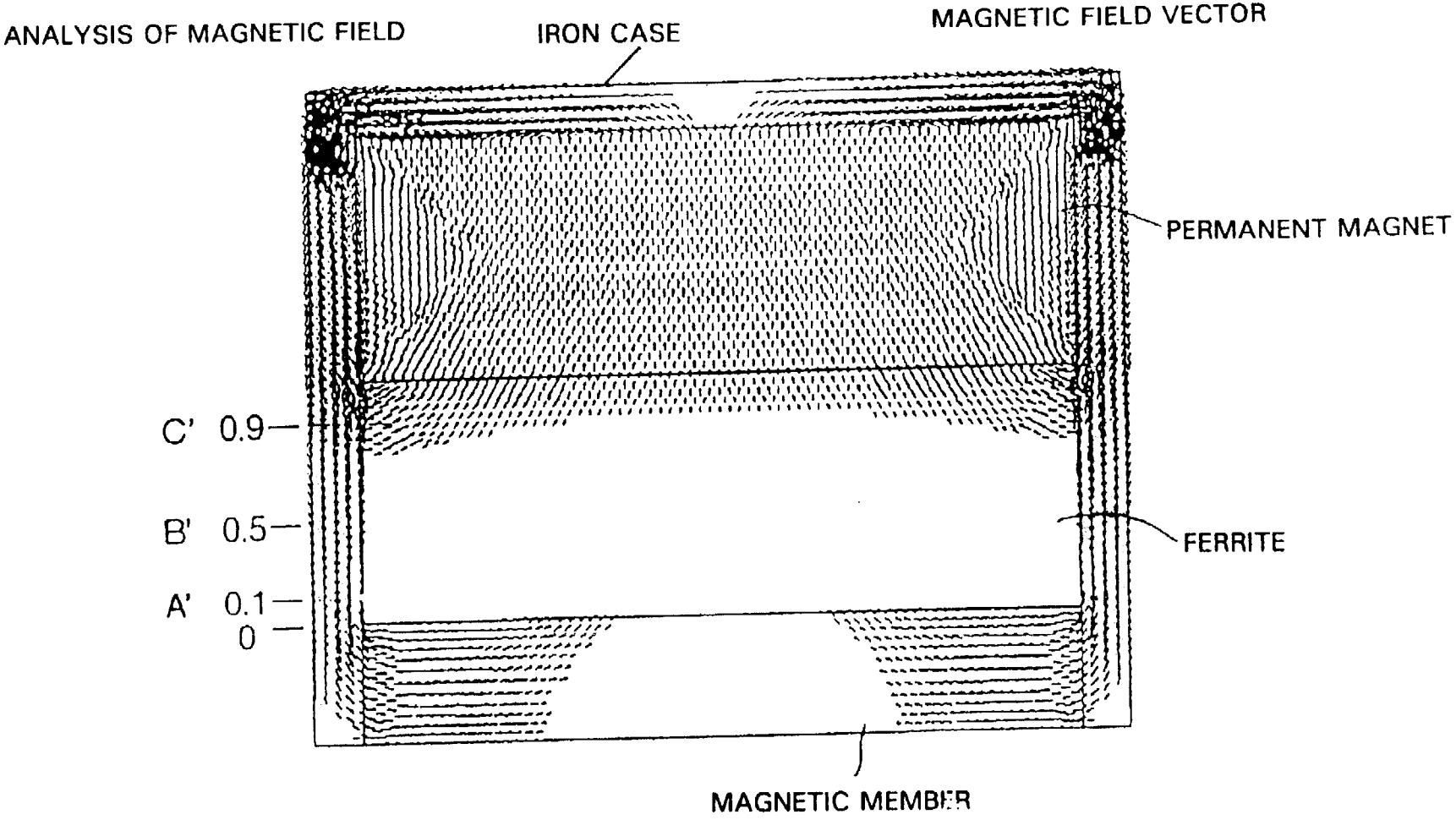
FIG. 8 is a characteristic diagram showing a result of an experiment made to confirm the advantages of the embodiments of the present invention.
Figure 9:
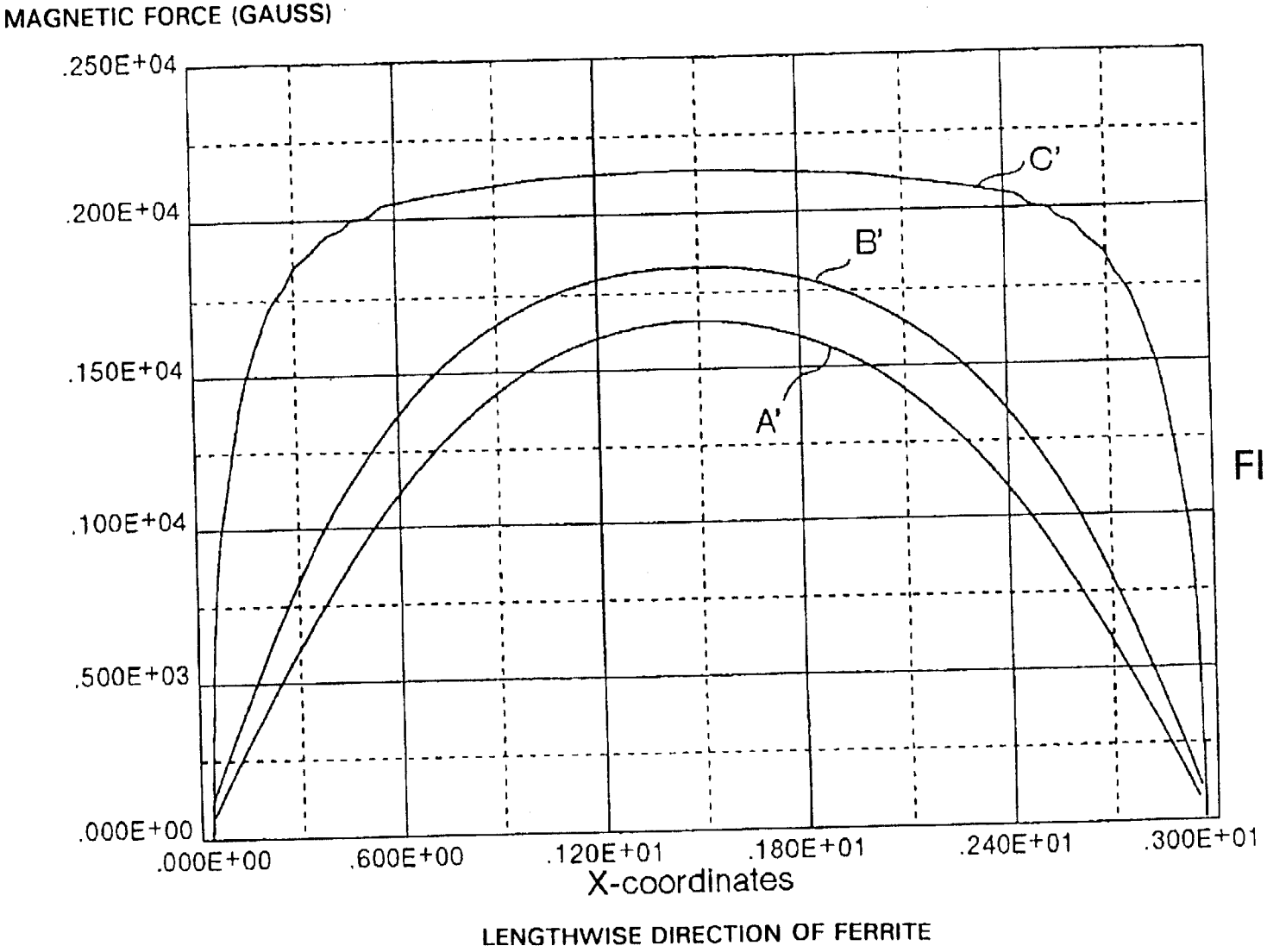
FIG. 9 is a characteristic diagram showing a result of the experiment.
Figure 10:
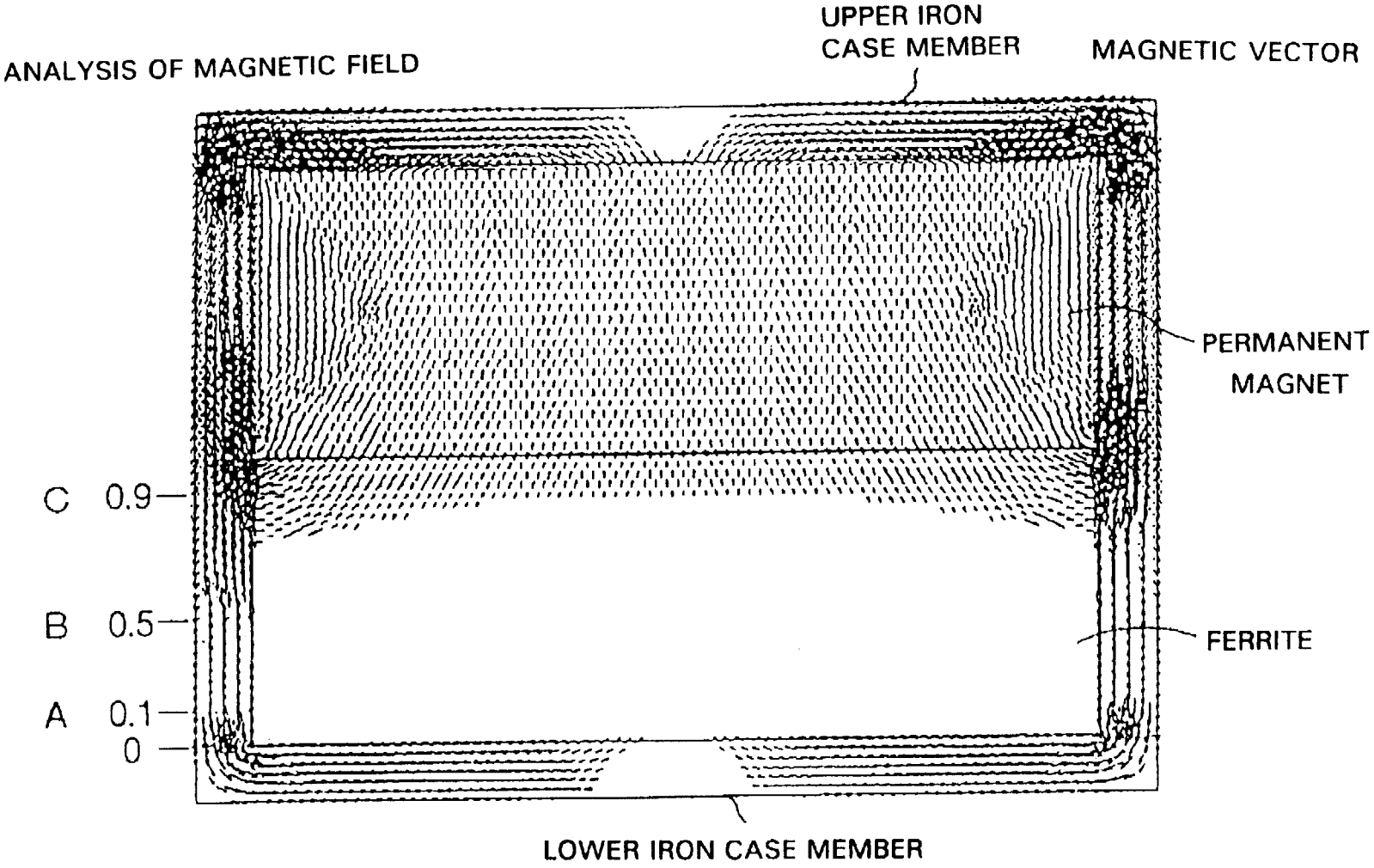
FIG. 10 is a characteristic diagram showing result of the experiment.
Figure 11:
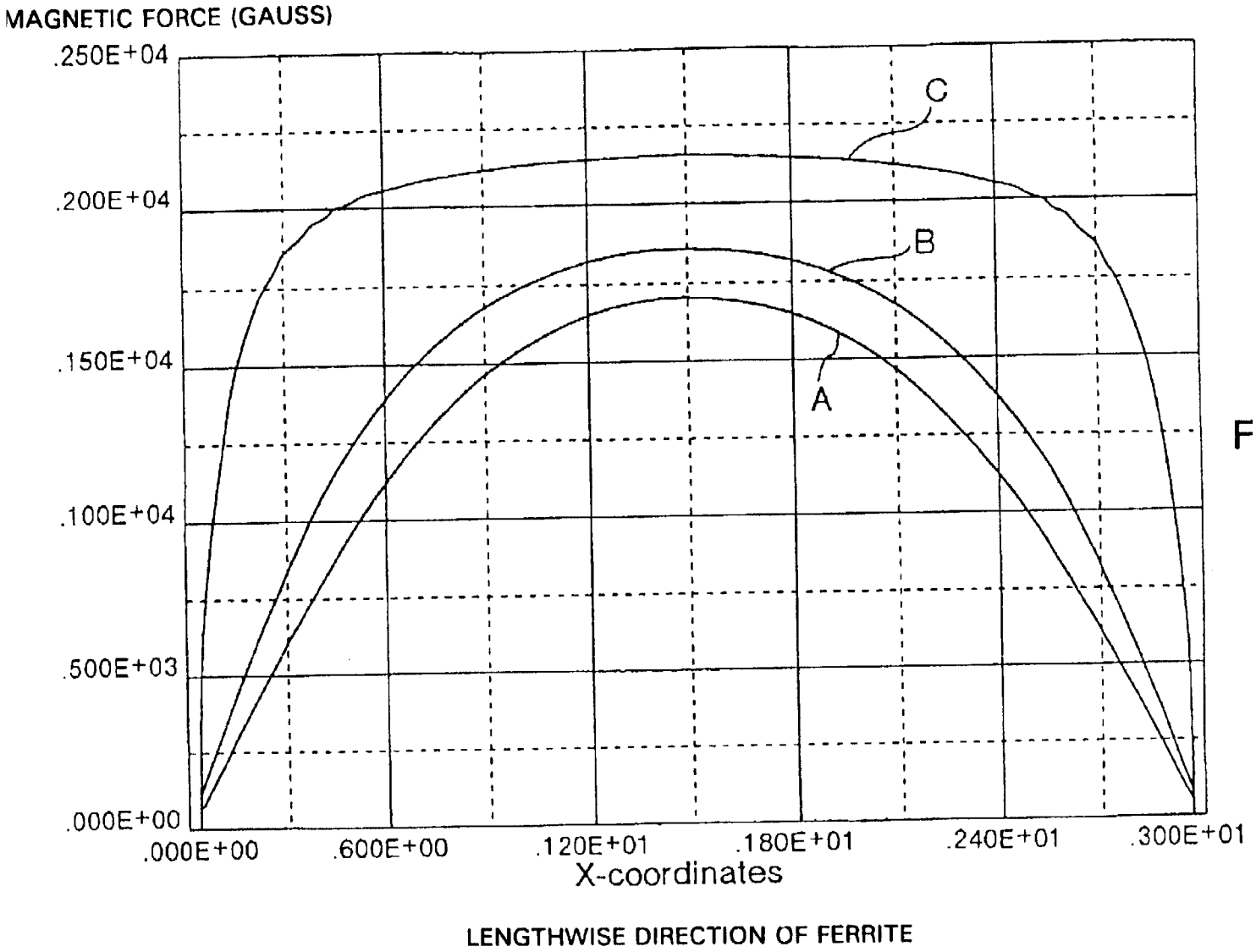
FIG. 11 is a characteristic diagram showing a result of the experiment.
Figure 12:
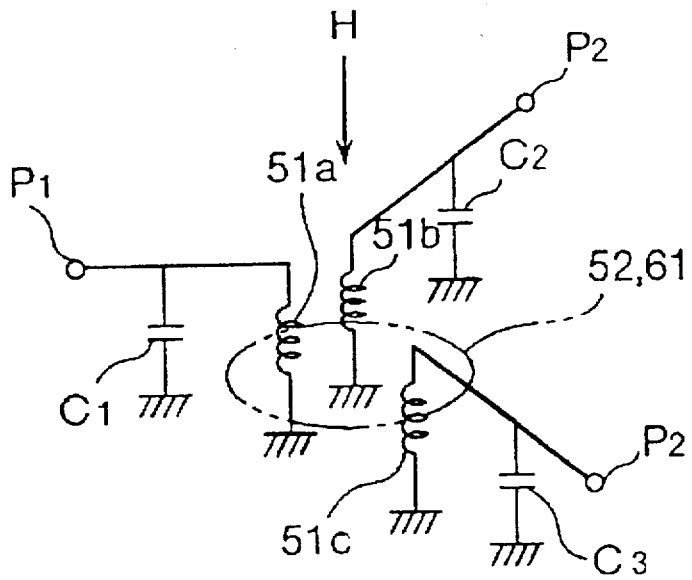
FIG. 12 is an equivalent circuit diagram of a conventional circulator.
Figure 16:
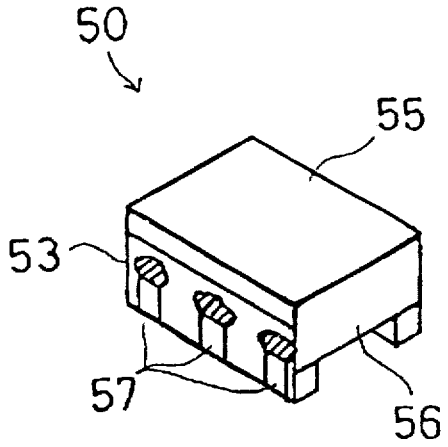
FIG. 16 is a perspective view of the conventional circulator shown in FIG. 15.
Figure 15:
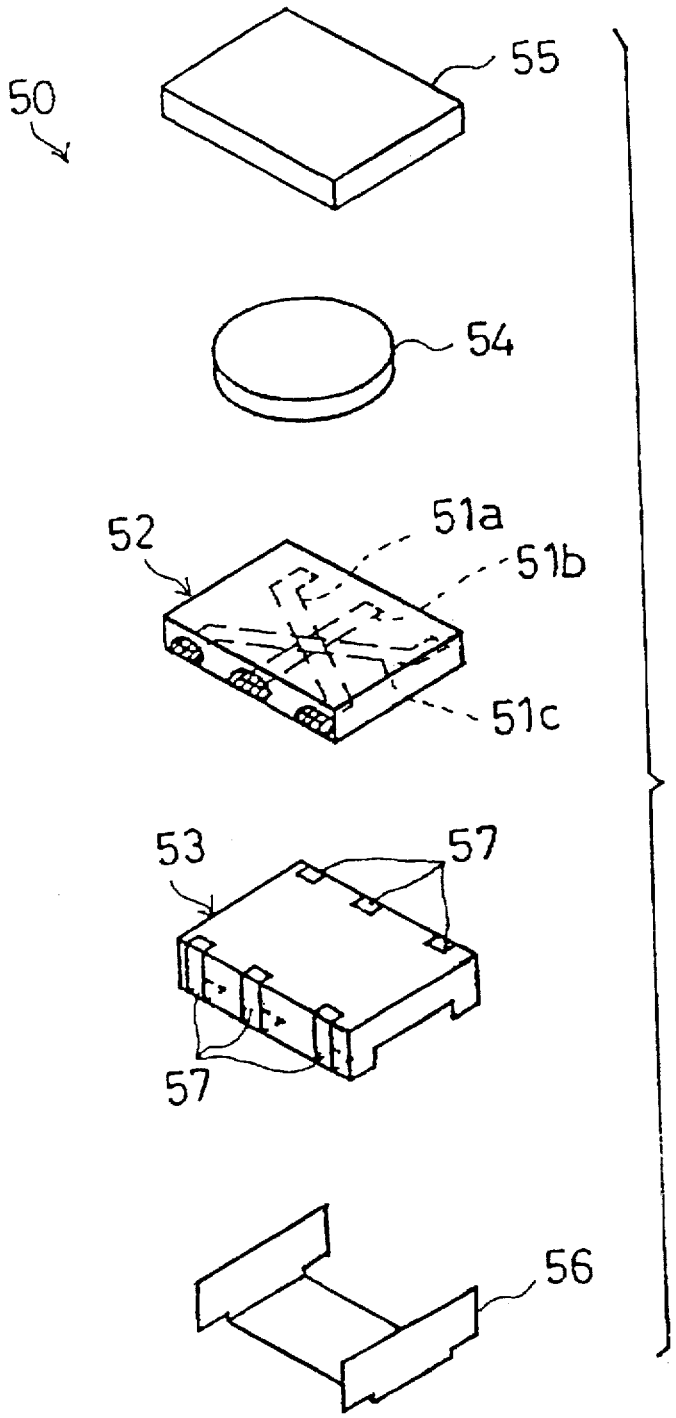
FIG. 15 is an exploded perspective view of another conventional circulator.

In this experiment, a circulator representing the above-described embodiments and having a magnetic member (having a permeability of 100) formed integrally with the lower surface of the above-described ferrite member was tested; magnetic field distributions and magnetic field curves of this circulator were measured (see FIGS. 8 and 9). The magnetic field curves were obtained by measuring the magnetic force at positions A', B', and C', 0.1 mm, 0.5 mm and 0.9 mm, respectively, apart from a position 0 corresponding to the lower surface of the ferrite member in the direction of thickness. The thickness and the inside diameter of the iron case were set to 0.2 mm and 3 mm, respectively, and the thicknesses of the permanent magnet and the ferrite member were set to 1.0 mm. A conventional circulator constructed by placing a lower iron case member (having a permeability of about 10000) placed under the lower surface of the ferrite member was prepared as a comparative example and was measured under the same conditions (see FIGS. 10 and 11).

As is apparent from the graphs and diagrams, the circulator in accordance with the embodiment of the present invention is generally equivalent to the conventional circulator with respect to both the parallelism and the magnetic field distribution and also has substantially the same characteristic with respect to the ferrite member magnetic field curves. Thus, the magnetic field strength and the distribution in the ferrite member are not substantially changed when the magnetic member is used in place of the conventional iron case member, and it can be said that no problem arises in forming a magnetic circuit of a circulator in accordance with the present invention.

However, taking into consideration the magnetic field leakage and anti-magnetic field due to the air layer of the conventional design, it is preferable to use a non-reciprocal circuit element in accordance with the present invention.

As described above, in the non-reciprocal circuit element provided according to the first aspect of the present invention, a magnetic member having a permeability higher than that of the ferrite member is formed integrally with at least one of the lower and upper surfaces of the ferrite member, thereby enabling the circuit element to be manufactured at a lower cost and with high parallelism, high homogeneity and low leakage of the magnetic field.

In the non-reciprocal circuit element provided according to the second aspect of the present invention, terminal electrodes to which input/output ports of electrode lines are connected are formed on surfaces of the magnetic member, thereby eliminating the need for the conventional resin block and reducing the number of connections. A cost reduction effect is also achieved thereby.

In the non-reciprocal circuit element provided according to the third aspect of the present invention, the ferrite member, the permanent magnet and the magnetic member are placed inside a yoke assembly made of a magnetic material having a permeability higher than that of the ferrite member and forming a closed magnetic circuit. In this case, the need for each of the upper and lower iron case members can be eliminated and manufacturing costs can be further reduced.

Although the present invention has been described in relation to particular embodiments thereof, many other variations and modifications and other uses will become apparent to those skilled in the art. Therefore, the present invention is not limited by the specific disclosure herein.

What is claimed is:

1. A non-reciprocal circuit element comprising:

a ferrite member having a center electrode section in which a plurality of electrode lines which function as inductance components are disposed so as to intersect each other at an intersecting portion by forming a predetermined angle between pairs of said electrode lines and being maintained in an electrical non-contacting state, said ferrite member also having matching capacitance electrodes connected to input/output ports of said electrode lines functioning as capacitance components;

a permanent magnet for applying a magnetic field to the intersection portion of said center electrode section of said ferrite member; and a magnetic member formed integrally with at least one of lower and upper surfaces of said ferrite member, said magnetic member being made of a magnetic material having a permeability higher than that of said ferrite member.

2. A non-reciprocal circuit element according to claim 1, wherein terminal electrodes to which the input/output ports of said electrode lines are connected are formed on at least one surface of said magnetic member, said magnetic member being electrically non-conducting.

3. A non-reciprocal circuit element according to claim 1, wherein said ferrite member, said permanent magnet and said magnetic member are disposed inside a magnetic yoke assembly comprising a magnetic material having a permeability higher than that of said ferrite member.

4. A non-reciprocal circuit element according to claim 2, wherein said ferrite member, said permanent magnet and said magnetic member are disposed inside a magnetic yoke assembly comprising a magnetic material having a permeability higher than that of said ferrite member.

5. A non-reciprocal circuit element according to claim 1, further comprising a second magnetic member formed integrally with at least one of lower and upper surfaces of said ferrite member, said second magnetic member being made of a magnetic material having a permeability higher than that of said ferrite member.

6. A non-reciprocal circuit element according to claim 5, wherein said ferrite member, said permanent magnet and said magnetic members are disposed inside a magnetic yoke assembly comprising a magnetic material having a permeability higher than that of said ferrite member.

7. A non-reciprocal circuit element according to claim 1, wherein the magnetic member is electrically non-conducting.

8. A non-reciprocal circuit element according to claim 1, wherein the magnetic member comprises one of Ni-Zn ferrite and Mn-Zn ferrite.

9. A non-reciprocal circuit element according to claim 1, wherein the ferrite member comprises one of yttrium-iron-garnet and calcium-vanadium-garnet.

10. A non-reciprocal circuit element according to claim 8, wherein the ferrite member comprises one of yttrium-iron-garnet and calcium-vanadium-garnet.

11. A non-reciprocal circuit element according to claim 3, wherein the magnetic yoke assembly comprises one of Ni-Zn ferrite and Mn-Zn ferrite.

12. A non-reciprocal circuit element according to claim 4, wherein the magnetic yoke assembly comprises one of Ni-Zn ferrite and Mn-Zn ferrite.

13. A non-reciprocal circuit element according to claim 1, wherein the magnetic permeability of the ferrite member is approximately 1 to 2. The ferrite member may have a magnetic permeability approximately 1 to 2.

14. A non-reciprocal element according to claim 1, wherein the integral formation of the magnetic member and the ferrite member eliminates an air gap between the magnetic member and the ferrite member.

15. A non-reciprocal element according to claim 1, wherein the magnetic permeability of the magnetic member is several hundred.

* * * * *